United States Patent [19]

Hubbs et al.

[11] 3,979,807

[45] Sept. 14, 1976

[54] TUFTING ASSEMBLY FOR UPHOLSTERED FURNITURE

[75] Inventors: Allan Hubbs, Huntington Station; Bert Weiss, Northport, both of N.Y.

[73] Assignee: Endura Manufacturing Corporation, Farmingdale, N.Y.

[22] Filed: June 23, 1975

[21] Appl. No.: 589,203

[52] U.S. Cl. ..... 29/91.4; 24/243 K

[51] Int. Cl.[2] ..... B68G 7/08

[58] Field of Search ..... 29/91.2, 91.3, 91.4; 24/265 A, 243 K, 30.5 R; 5/356

[56] References Cited

UNITED STATES PATENTS

| | | | |
|---|---|---|---|
| 1,407,291 | 2/1922 | Miller | 24/265 A |
| 2,223,594 | 12/1940 | Bednarek | 5/356 X |
| 3,266,711 | 8/1966 | Song | 24/243 K |

FOREIGN PATENTS OR APPLICATIONS

| | | | |
|---|---|---|---|
| 224,268 | 2/1943 | Switzerland | 24/265 A |

*Primary Examiner*—Leon Gilden

*Attorney, Agent, or Firm*—Edward H. Loveman

[57] ABSTRACT

Furniture tufting means includes a clip made of pliable material having a channel shaped body formed with a rectangular bottom wall, a flat tongue overlies the bottom wall, and the side walls are folded over the tongue to form a rigid three-layer structure. A flexible tape is wound around the side walls and under the tongue. The clip is longer than the width of the tape and extends out beyond opposite lateral edges thereof.

5 Claims, 7 Drawing Figures

TUFTING ASSEMBLY FOR UPHOLSTERED FURNITURE

This invention concerns a tufting assembly for upholstered furniture and more particularly concerns an improved anchoring device for such an assembly.

In the art of upholstered seating there are many types of tufting. The tufting provides an aesthetically pleasing appearance and performs other functions. It retains the substructure which may be made of soft organic or foam type material used to provide a resilient body or padding under the cover material. It serves to anchor the surface cover and prevent it from shifting during use of the seating. The tufting also keeps the cover material in stretched condition, so that even after extended use, the furniture will retain a look of newness.

One of the commonly used methods of tufting is to attach a flexible member such as a tape or cord to a button, to insert this flexible member through a hole in the cover material and padding, to pull the button down to compress the structure, and then to attach the flexible member to some base which may be a furniture frame or other support.

One conventional tufting method employs a woven tape on which is attached a metal clip joined at right angles to the length of the tape and extending outwardly from opposite lateral edges of the tape. The tape is formed into a loop with ends of the tape secured by a clasp to which a button is attached. The button is at one end of the loop and the clip is located at the other end of the loop.

The clip serves to anchor the tufting assembly to the furniture frame or support and must be strong enough to withstand heavy stresses and strains imparted during use of the furniture. Prior anchoring clips have been formed with teeth or serrated edges to grip the tape securely. This type of attachment has not been satisfactory because the teeth or sharp projections weaken the tape which tears and pulls loose from the anchor clip during use of the furniture. In order to avoid teeth or sharp points on the anchor clip a U-shaped clip with straight edges has been devised to enclose the end of the tape loop in a double wrap. The clip is made of pliable metal to permit folding edges of the clip. This arrangment avoids cutting the tape, but the clip has the advantages that it tends to bend when subjected to heavy stresses and strains during use of the furniture. When the clip bends it pulls loose from the furniture frame or support, so the entire tufting assembly fails.

The present invention is directed at overcoming the above and other difficulties and disadvantages of prior furniture tufting systems, by providing a pliable channel shaped metal clip with a tongue therein. The body of the clip is longer than the width of the tape. The tape is wrapped around the body of the clip with ends of the body projecting outwardly of the tape. The tongue is pushed down on the tape inside the channel. Then the sides of the channel are bent down on the tongue to enclose the tape in a sinuous wrap. Two layers of the tape extend completely around the tongue inside the clip and is retained securely therein with a uniform grip along the entire width thereof by the tongue and by adjacent edges of the body of the clip. The clip has a triple layered construction which is very strong and resists bending. It will not come loose even under maximum stresses and strains to which the furniture seating is subjected. The joint of clip to tape is at least as strong as the tape itself. The tape may be of woven nylon or other material having great tensile strength. The tape is formed into a loop with conventional clasp and button at other ends of the loop. After fabrication, the tufting assembly which has a fixed length can be installed in the furniture seating in conventional manner.

It is, therefore, a principal object of the present invention to provide a novel anchoring clip for a furniture tufting assembly, which clip includes a channel shaped pliable metal body and central tongue around which a tufting tape can be wound, with ends of the clip projecting beyond edges of the tape.

A further object of the present invention is to provide an anchoring clip as described which forms a triple layer when edges of the clip are folded down on the tongue.

Still another object of the present invention is to provide an anchoring clip as described, wherein a flexible tape is engaged in sinuous fashion around the body of the clip and tongue in a double wrap to form a joint which is at least as strong as the tape itself.

Another object of the present invention is to provide a furniture tufting assembly comprising a length of flexible tape formed into a loop, and engaged by a clasp and button, and with an anchoring clip as described above attached to ends of the tape.

These and other objects and many of the attendant advantages of this invention will be readily appreciated as the same becomes better understood by reference to the following detailed description when considered in connection with the accompanying drawings in which.

Figure 1:
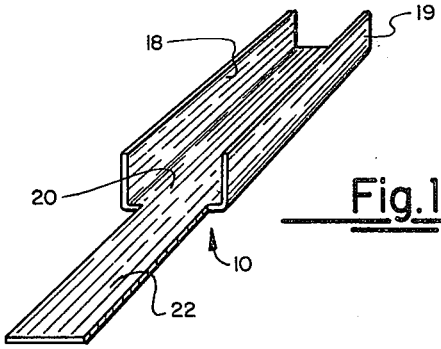
FIG. 1 is a perspective view of an anchoring clip per se with tongue extended from the body of the clip.

Referring now to the drawings wherein like reference characters designate like or corresponding parts throughout, there is illustrated in FIGS. 1–7, an anchoring clip generally designated as reference numeral 10 for a furniture tufting assembly 12. The clip 10 is made of pliable metal such as sheet steel and has an elongated channel shaped body 16 with a pair of rectangular side walls 18 and 19. Initially the side walls 18, and 19 stand up parallel to each other and perpendicular to a rectangular bottom wall 20 as shown best in FIGS. 1 and 2. A flat tongue 22 is integral with the wall 20 extending outwardly thereof and coplanar thereto. The tongue 22 is slightly narrower than the wall 20 and substantially as long as the walls 18, 19 and 20. Each of the walls 18 and 19 are about one-half the width of the wall 20.

Figure 2:
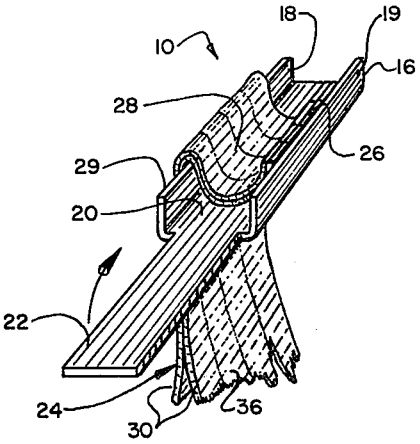
FIG. 2 and FIG. 3 are perspective views of the anchoring clip showing successive steps in attachment of the clip to a tufting tape.

To make the tufting assembly, a flexible cloth tape generally designated as reference numeral 24, is placed in the body 16 of the clip 10 as shown in FIG. 2 in a U-shaped configuration. Both end sections 26 of the tape 24 are placed against the side walls 19. Bight sections 28 of the tape 24 extend across the wall 20 and adjacent sections 32 are draped against the other wall 18. The body 16 of the clip 10 is longer than the width of the tape 24 so that the walls 18, 19 and 20 extend outwardly of opposite lateral edges 30 of the tape 24.

Figure 3:
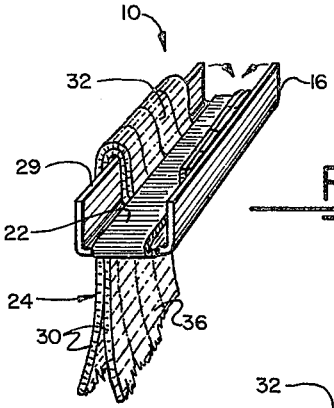

FIG. 3 shows a further step in completing the assembly. The tongue 22 is folded up and over the bight sections 28 of the tape 24 and is pressed down firmly on the wall 20 with the bight sections 28 of the tape 24 thereinbetween. Adjacent sections 32 of the tape 24 extend up the side wall 18 and around a side wall edge 29 of the clip 10.

Figure 4:
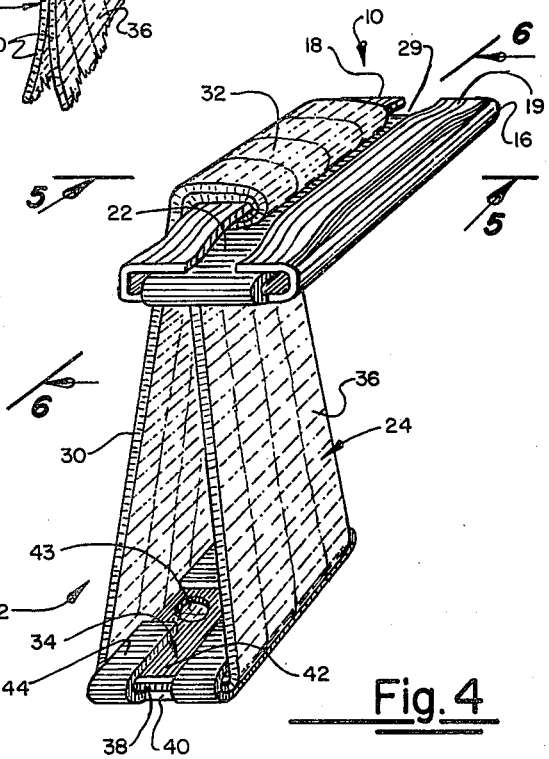
FIG. 4 is a perspective view, a tufting assembly showing the anchoring clip attached to the tufting tape.
Figure 5:
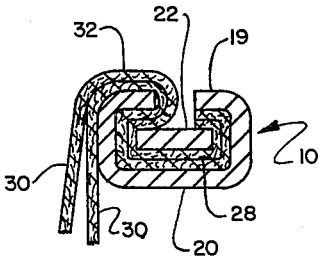
FIG. 5 is an enlarged fragmentary cross sectional view taken along line 5—5 of FIG. 4.
Figure 6:
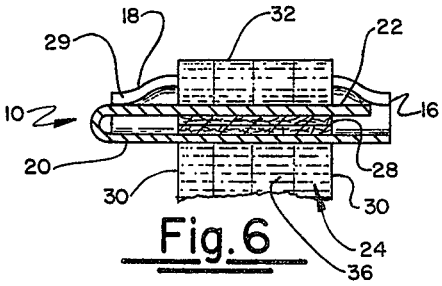
FIG. 6 is a further enlarged fragmentary sectional view taken along line 6—6 of FIG. 4 at right angles to the section of FIG. 5.

FIGS. 4, 5 and 6 show the completed tufting assembly. The side walls 18 and 19 have been folded inwardly on the tongue 22. The tape 24 is now doubly wrapped around the tongue 22. As clearly shown in FIG. 5, the tape sections 32 and the bight sections 28 extend entirely around the tongue 22 and the sections 32 further extend entirely around the side wall 18 of the clip 10 which now has a triple layer construction. The walls 18, 19 and 20 are the outer layers and the tongue 22 is the inner layer. Between the layers are the tape sections 26, 28 and 32 of the tape 24. By this arrangement the tape 24 is held with uniform tension across its entire width. The joint is at least as strong as the tape 24. The tape 24 cannot be pulled away from the clip 10 without breaking the clip 10 or the tape 24.

The tufting assembly 12 is further completed by attachment of a clasp generally designated as reference numeral 34 to an end of a loop 38 of the tape 24; see FIG. 4. The clasp 34 may be formed of two thin plates 40, 42 having an aperture 43. Tabs 44 formed on ends of the outer plate 40 are folded inwardly over the inner plate 42 to secure the clasp 34 to the tape 24.

Figure 7:
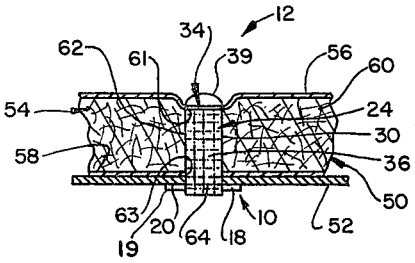
FIG. 7 is a reduced size elevational view of the tufting assembly shown installed in a furniture seat, parts of which are shown in cross section.

FIG. 7 shows a tufting assembly generally designated as reference numeral 12 installed in a furniture seat 50 which has a base frame 52 on which is placed a cushion 54. The cushion 54 has upper and lower layers 56,58 made of upholstery fabric, plastic sheeting, or the like. A resilient padding 60 is disposed between and enclosed by the layers 56, 58. A button 39, which is disposed in the aperture 43 of the clasp 34 overlays the layer 56. The sides 36 of the tape loop are tensioned and extend through holes 61, 62, 63 and 64 in the layer 56, the padding 60, the layer 58, and the frame 52 respectively. The outer side of the wall 20 of the clip 10 abuts the underside of the frame 52. The walls 18, 19 and 20 along with the tongue 22 extend laterally of the hole 64 in the frame 52 beyond both lateral edges 30 of the tape 24. The clip 10 is installed in the furniture seat 50 by compressing the padding 60 and pushing the clip 10 endwise through the holes 61, 62, 63 and 64. When the padding 60 is released, the tape tension is restored and the clip 10 is locked in place on the underside of the frame 52 as shown in FIG. 7. This forms a snug fitting assembly which will not twist or slide and which cannot come loose and will not fail under heavy stresses and strains encountered during use of the seat.

Although the clip has been illustrated with the tongue integral with the bottom wall, it is obvious that the tongue may be separated therefrom.

It should be understood that the foregoing relates to only a preferred embodiment of the invention, and that it is intended to cover all changes and modifications of the example of the invention herein chosen for the purposes of the disclosure, which do not constitute departures from the spirit and scope of the invention.

The invention claimed is:

1. A furniture tufting means for securing an upholstered cushion to a support comprising:

a clip made of pliable material and having an elongated channel shaped body formed with a rectangular bottom wall and two rectangular side walls each having a width about one half that of said bottom wall, and a flat tongue substantially as long as said bottom wall and said side walls and narrower than said bottom wall to fit between said side walls when said tongue is positioned over said bottom wall; and a flexible tape having both end sections wound around said tongue and extending around both of said side walls of said clip, and wherein said side walls of said clip are folded over said tongue substantially parallel to each other with adjacent edges slightly spaced apart, said two end sections of said tape extending around said walls and said bottom wall, so that said tape sections are secured between said tongue and said bottom wall and between said tongue and said side walls of said clip.

2. A furniture tufting means as defined in claim 1, wherein said tape is narrower than the length of said body of said clip so that opposite ends of said clip extend outwardly of lateral edges of said tape for engagment on said support.

3. A furniture tufting means as defined in claim 1, further comprising:

a clasp attached to a loop of said tape with two opposing sides of fixed length, said clasp being located at one end of said loop and said clip at the other end of said loop, whereby said sides of said tape are tensioned and extend through said cushion and said clasp seats snugly on said cushion, when said clip is engaged on said support.

4. A furniture tufting means as defined in claim 2, further comprising:

a button secured to said clasp and to said tape to lock said clasp on said cushion.

5. A furniture tufting means as defined in claim 1, wherein said tongue is integrally formed with one end of said bottom wall.

* * * * *